US007490663B2

(12) United States Patent
Lewis et al.

(10) Patent No.: US 7,490,663 B2
(45) Date of Patent: Feb. 17, 2009

(54) THREAD FATIGUE RELIEF FOR TOOL JOINT

(75) Inventors: Evan G. Lewis, Kingwood, TX (US); Mohan L. Soni, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 69 days.

(21) Appl. No.: 11/642,422

(22) Filed: Dec. 20, 2006

(65) Prior Publication Data

US 2008/0149324 A1 Jun. 26, 2008

(51) Int. Cl.
*E21B 29/00* (2006.01)
*E21B 43/11* (2006.01)

(52) U.S. Cl. ..... 166/55.1; 166/55.6

(58) Field of Classification Search ..... 166/298, 166/55.1, 55.6
See application file for complete search history.

(56) References Cited

U.S. PATENT DOCUMENTS 5,425,419 A 6/1995 Sieber
5,553,671 A * 9/1996 Sieber ..... 166/381
5,894,889 A 4/1999 Dewey et al.
6,109,347 A 8/2000 Ferguson et al.
6,170,576 B1 * 1/2001 Brunnert et al. ..... 166/298

FOREIGN PATENT DOCUMENTS

GB 2420359 A 5/2006

* cited by examiner

*Primary Examiner*—William P Neuder
(74) *Attorney, Agent, or Firm*—Steve Rosenblatt

(57) ABSTRACT

A bottom hole assembly used for making a window in a tubular is modified to reduce tool joint stress in a connection above the topmost watermelon mill. A protrusion is located between the topmost watermelon mill and the next threaded joint uphole. Preferably, the protrusion height is not greater than the outside dimension of the largest watermelon mill. Preferably, the protrusion is located below the upset area in the tubular where the threaded joint is made up and about ⅓ the distance downhole from the threads to the next adjacent watermelon mill.

7 Claims, 3 Drawing Sheets

THREAD FATIGUE RELIEF FOR TOOL JOINT

FIELD OF THE INVENTION

The field of the invention relates to techniques for reducing stress in a threaded joint subjected to bending stresses when used downhole and more particularly to window milling assemblies that operate in conjunction with a diverter commonly known as a whipstock.

BACKGROUND OF THE INVENTION

At times during the life of a well a lateral is necessary to tap into an existing producing zone in a new location or to access a different producing zone, for example. This lateral is created by locating a diverter or whipstock a desired depth and orientation. In one trip operations, the whipstock has a series of mills attached to a lug at the top of a whipstock ramp. The milling assembly can have an initial mill, known as a window mill and one or more oblong mills generally shaped like a ripe watermelon and commonly referred to as watermelon mills. The window mill is initially diverted laterally by the ramp on the whipstock so as to begin the long window that is typically narrower near the top and gets wider further down as the window mill makes an exit and the first of what could be several watermelon mills enters the window started by the window mill. The ramp can be long enough to have the window and watermelon mills on or even extending beyond the whipstock ramp and through the window. Experience and modeling studies have shown that the weak link in this system is the threaded connection just above the uppermost watermelon mill. In the past, stresses on this joint have caused it to fail.

The present invention addresses this concern by strategically locating a protrusion on the exterior of the tubular between the upset area of the threaded connection and the topmost watermelon mill. As a result of doing this stress is concentrated at the reduced diameter below the protrusion and the degree of bending at the threaded connection is reduced. The reliability and service life of the threaded connection is increased. Those skilled in the art will more readily appreciate the scope of the invention from a review of the description of the preferred embodiment and associated drawings that appear below while recognizing that the full scope of the invention is to be found in the claims.

SUMMARY OF THE INVENTION

A bottom hole assembly used for making a window in a tubular is modified to reduce tool joint stress in a connection above the topmost watermelon mill. A protrusion is located between the topmost watermelon mill and the next threaded joint uphole. Preferably, the protrusion height is not greater than the outside dimension of the largest watermelon mill. Preferably, the protrusion is located below the upset area in the tubular where the threaded joint is made up and about ⅓ the distance downhole from the threads to the next adjacent watermelon mill.

DETAILED DESCRIPTION OF THE PREFERRED EMBODIMENT

Figure 1:
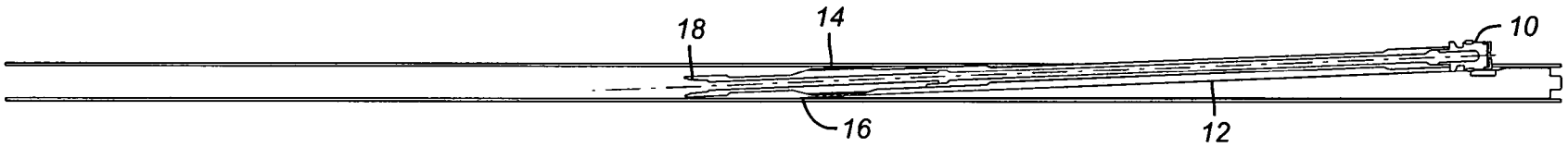
(PRIOR ART) FIG. 1
FIG. 1 is a prior art assembly for making a window showing a window mill and a single watermelon mill.

FIG. 1 illustrates the problem addressed by the invention in an assembly of a window mill 10 going down a whipstock ramp 12 to the point where it has penetrated the tubular or casing (not shown) and a watermelon mill 14 is moved down to the point of entry onto ramp 12 near its top 16. A tubular string (not shown) is connected to thread 18 and extends to the surface. This string is rotated and advanced as the mills 10 and 14 advance along the whipstock ramp 12. At the time the components get to the position shown in FIG. 1, the connection at thread 18 sees the maximum stress as indicated by peak 20 in the graph of FIG. 5. Peak 20 occurs at the thread 18, which in the test reflected by FIG. 5 happens at about 23 feet from the kick-off point (KOP) which is where the window mill is located at the outset of milling. Regardless of the weight per foot or thickness of the casing where the window is being made, the peak stress happens at the threaded connection 18 and that is at a time when the watermelon mill just below it enters the whipstock ramp as shown in FIG. 1.

Figure 2:
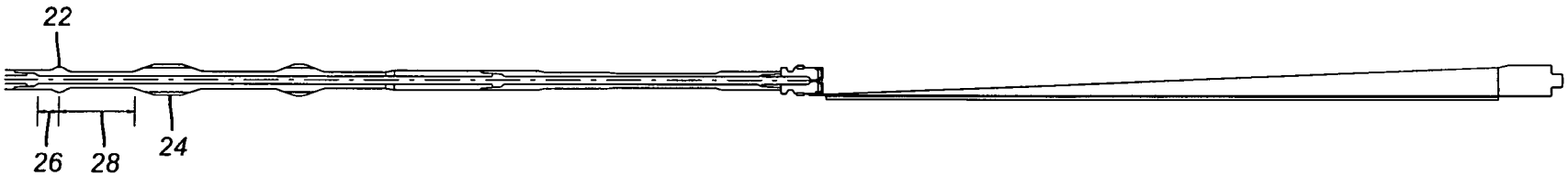
FIG. 2 is a view of the assembly of the present invention with the window mill still attached to the top of the whipstock before milling begins.
Figure 3:
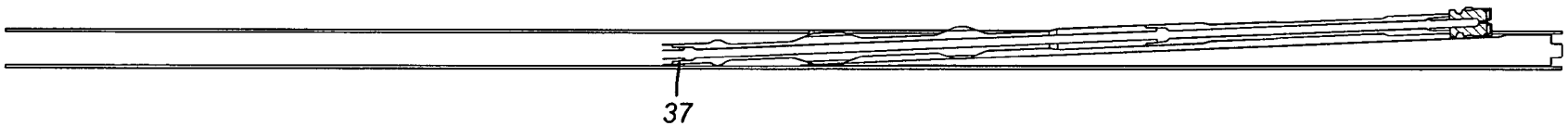
FIG. 3 shows the uphole watermelon mill of FIG. 2 on the whipstock and the protrusion reducing stress on the threaded joint above it.
Figure 4:
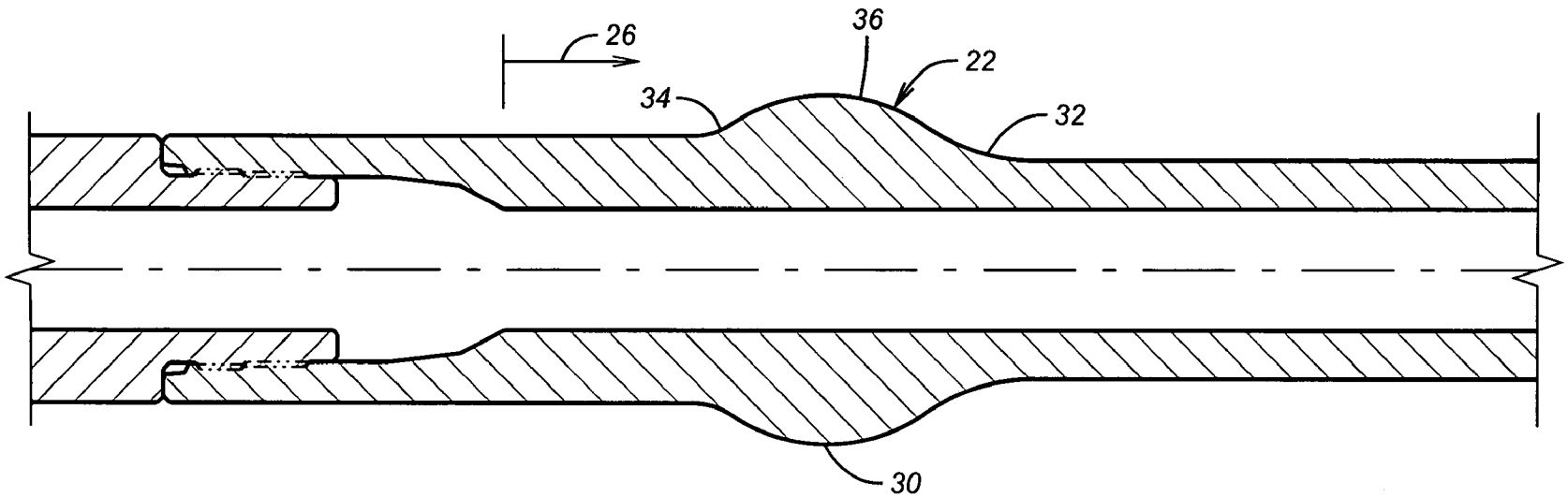
FIG. 4 is closer view of the upper watermelon mill and threaded joint above it that are also shown in FIG. 3.

The present invention seeks to reduce the peak stress at the threaded connection 18 by adding a fulcrum 22 between the thread 37 and the closest watermelon mill 24, as shown in FIG. 3. The maximum radial extension of the fulcrum 22 should not exceed the maximum radial dimension of the adjacent watermelon mill 24. The placement of the fulcrum 22 should be in a zone away from the thread form zone as indicated schematically in FIG. 4 by arrow 26. The choice of placement for the fulcrum 22 can best be seen from FIGS. 2 and 4 with 26 representing the zone for the top of the fulcrum, whose specific shapes will be addressed below, and 28 representing the remaining length to the top of the next watermelon mill 24. The preferred location for the peak dimension 30 of the fulcrum 22 preferably making dimension 28 about twice the length of dimension 26 although further uphole or downhole can be other possible locations. The preferred shape for the fulcrum 22 is generally rounded so that sharp transitions such as radial ledge surfaces are avoided because they concentrate stresses. For that reason, transitions 32 and 34 and the surface 36 in between are preferably curved. The fulcrum 22 contacts the surrounding tubular when the watermelon mill 24 contacts the whipstock ramp 12.

Figure 5:
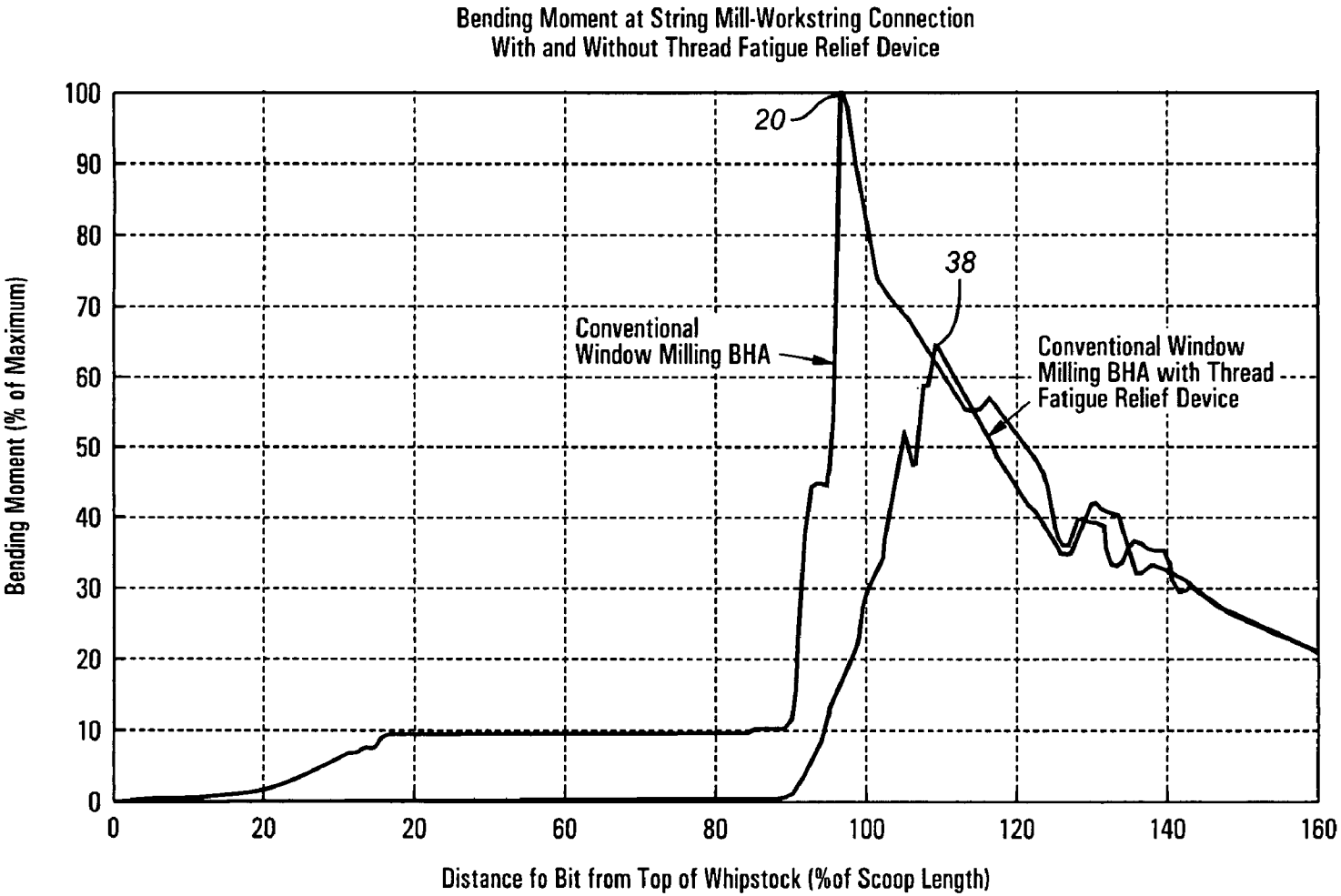
FIG. 5 is a graph of the percentage of maximum bending moment plotted against distance to bit from top of whipstock.

The graph of FIG. 5 indicates that with the fulcrum 22 in position bending moment at the location of the thread 37 which is located at 100% of the scope length has seen a reduction in peak stress of approximately ⅓ through the reduction of bending moment, as indicated by points 20 and 38 respectively in FIG. 5.

Those skilled in the art will appreciate that the addition of the fulcrum 22 allows more bending stress to occur closer to the watermelon mill 24 and at the fulcrum 22 location with the result that a lower bending stress is indicated at thread 37. Thread 37 is the weak point in the system and a reduction of stress at that location will improve reliability of milling operations and reduce failures of that connection during milling a window.

The above description is illustrative of the preferred embodiment and many modifications may be made by those skilled in the art without departing from the invention whose scope is to be determined from the literal and equivalent scope of the claims below.

We claim:

1. A milling assembly for window milling off a whipstock in a tubular downhole, comprising:

a window mill;

at least one watermelon mill connected to said window mill;

a tubular having an outer dimension and extending from the opposite end of said watermelon mill as compared to said window mill, said tubular leading to a threaded connection portion; and a projection located between said thread and said watermelon mill and extending radially beyond said outer dimension but to a lesser extent than said watermelon mill, said projection reducing stress on said threaded connection portion when said watermelon mill contacts the whipstock.

2. The assembly of claim 1, wherein:

said projection is spaced apart from the threaded connection portion.

3. The assembly of claim 2, wherein:

said projection is closer to said threaded connection portion than said watermelon mill.

4. The assembly of claim 3, wherein:

the distance from said projection to said threaded connection portion is less than half the distance from said projection to said watermelon mill.

5. The assembly of claim 1, wherein:

said projection has a generally rounded contour.

6. The assembly of claim 1, wherein:

said projection is forced against the tubular when said watermelon mill contacts the whipstock.

7. The assembly of claim 1, wherein:

the presence of said projection reduces stress on said threaded connection by as much as ⅓ as compared to the stress at the threaded connection when there is no said projection.

* * * * *